US010035189B2

(12) United States Patent
Boswell et al.

(10) Patent No.: US 10,035,189 B2
(45) Date of Patent: Jul. 31, 2018

(54) METHOD AND APPARATUS FOR SEPARATING A CANISTER AND COMPONENT

(71) Applicant: ROLLS-ROYCE PLC, London (GB)

(72) Inventors: John Harold Boswell, Derby (GB); Daniel Clark, Derby (GB)

(73) Assignee: ROLLS-ROYCE plc, London (GB)

( * ) Notice: Subject to any disclaimer, the term of this patent is extended or adjusted under 35 U.S.C. 154(b) by 873 days.

(21) Appl. No.: 14/476,291

(22) Filed: Sep. 3, 2014

(65) Prior Publication Data

US 2015/0064049 A1 Mar. 5, 2015

(30) Foreign Application Priority Data

Sep. 5, 2013 (GB) ..... 1315782.1

(51) Int. Cl.
*B22F 3/12* (2006.01)
*B22F 3/15* (2006.01)

(52) U.S. Cl.
CPC ..... *B22F 3/1291* (2013.01); *B22F 3/1241* (2013.01); *B22F 3/1266* (2013.01); *B22F 3/1283* (2013.01); *B22F 3/15* (2013.01); *B22F 2003/153* (2013.01); *Y10T 29/49826* (2015.01); *Y10T 29/49963* (2015.01)

(58) Field of Classification Search
CPC ..... B22F 3/15; B22F 3/153
USPC ..... 425/77, 405.1, 405.2
See application file for complete search history.

(56) References Cited

U.S. PATENT DOCUMENTS

| | | | | |
|---|---|---|---|---|
| 3,939,241 | A | 2/1976 | Powell et al. | |
| 3,986,870 | A | 10/1976 | Danieli et al. | |
| 4,094,672 | A | 6/1978 | Fleck et al. | |
| 4,178,178 | A | 12/1979 | Garvare et al. | |
| RE31,355 | E * | 8/1983 | Rozmus | B22F 3/1208 425/405.2 |
| 5,077,022 | A | 12/1991 | Polizzotti | |
| 2006/0127265 | A1 | 6/2006 | Voice et al. | |
| 2007/0074841 | A1 | 4/2007 | Voice et al. | |

FOREIGN PATENT DOCUMENTS

| | | |
|---|---|---|
| JP | A-54-99714 | 8/1979 |
| JP | S54-99012 A | 8/1979 |
| JP | A-57-210902 | 12/1982 |
| JP | A-5-179307 | 7/1993 |
| WO | 2012/092975 A1 | 7/2012 |

OTHER PUBLICATIONS

Apr. 9, 2015 Search Report issued in European Application No. 14 18 2566.
United Kingdom Search Report issued in GB1315782.1 dated Feb. 21, 2014.

* cited by examiner

*Primary Examiner* — Joseph S Del Sole
*Assistant Examiner* — Thu Khanh T Nguyen
(74) *Attorney, Agent, or Firm* — Oliff PLC

(57) ABSTRACT

A method and apparatus for removing a canister 12 from a component 18 by forming an opening 30 in the canister wall thickness 14, 16 and introducing a pressurised fluid into the opening 14, 16 causing hydrostatic pressure build up between an internal canister surface 14 and the component 18, leading to the removal of the canister 12. This method and apparatus obviates the need to expend significant machining or chemical processing to remove the canister 12.

14 Claims, 5 Drawing Sheets

METHOD AND APPARATUS FOR SEPARATING A CANISTER AND COMPONENT

FIELD OF THE INVENTION

The present invention relates to method and apparatus for separating a component from a canister post Hot Isostatic Pressing (HIP).

BACKGROUND TO THE INVENTION

A HIP process is known in which the alloy raw material, in powder form, is introduced into a specially shaped deformable canister which defines the shape of the desired component, and is usually formed from a mild steel or stainless steel. The canister is filled with a metal or a composite powder, the chamber is evacuated and sealed, and the canister is subjected to hot isostatic pressing using elevated temperatures and pressures, thereby consolidating the powder particles, and bonding these powder particles to form the resultant near net shaped component.

The canister is then removed either mechanically using machining or chemically using a pickling process, or a combination of these processes. The cost and timescales involved in both processes can make near net processing less attractive from both an environmental and cost perspective. A method of removing the metal canister post HIP that does not require either of these processes would be advantageous. It is an object of the present invention to seek to provide an improved method of separating a canister from a processed component.

SUMMARY OF THE INVENTION

The invention is set out in the appended claims.

According to a first aspect of the present invention, there is provided a method of separating a hipping (HIP) canister from a hot isostatically pressed component, the method comprises steps of: providing at least one opening extending through a wall of the hipping canister; and supplying a fluid under pressure through the opening to separate the canister surface from the component.

Optionally the canister wall has a thickening in the region of the opening and the method comprises removing a portion of the thickening to uncover a blocking material.

Optionally the blocking member is provided in an aperture in the canister and is removed to provide an opening.

Preferably the portion of the thickening is removed by drilling or grinding.

The removal method does not interfere with the processed component surface, hence the processed near net shaped component is protected.

Preferably the blocking material is removed by applying a solution to the material that dissolves the material.

Preferably the applied solution is alkaline and the material is a ceramic.

The ceramic preferably exhibits chemical properties enabling it to be leached out using an alkaline solution.

Preferably the thickening portion has an attachment feature for a fluid supply conduit, wherein the method comprises the step of attaching a fluid supply conduit to the attachment feature.

The attaching of fluid supply conduit to the attachment portion is made by a mechanical fastening technique. Optionally the step of attaching the fluid supply conduit comprises screwing the conduit onto a screw thread formed on an external surface of the attachment portion.

The attaching of fluid supply conduit to the attachment portion is made by a mechanical fastening technique. Optionally the step of attaching the fluid supply conduit comprises screwing the conduit onto a screw thread formed on an internal surface of the attachment portion. The attachment may be made by any mechanical fastening technique.

The attaching of fluid supply conduit to the attachment portion is made by a mechanical fastening technique. Optionally the step of attaching the fluid supply conduit comprises clipping or welding the conduit to the attachment portion. The attachment may be made by any mechanical fastening technique.

According to a second aspect of the present invention, a canister for a hot isostatic press (HIP) process comprising: a canister wall having a first surface and an opposite second surface, wherein an aperture opens to the first surfaces and contains a blocking member, the second surface having an attachment member for attachment to a fluid supply conduit.

Optionally the attachment member comprises a thickened portion extending from the second surface. The thickened portion having a thickness which is at least greater than canister wall thickness.

Preferably the aperture extends from the first surface into the attachment member. The blocking member may fill the opening within the canister wall or may also extend at least partially into the blind aperture of the attachment member.

Preferably the blocking member extends into the attachment member. The blocking member may partially extend into the blind aperture within the attachment member.

Optionally a diffusion bonding resistant layer is deposited on the first canister surface. The diffusion bonding resistant layer prevents the component bonding to the canister first surface during processing. Post processing, the diffusion bonding resistant layer acts as brittle interface between the canister first surface and the component surface, allowing separation of the canister from the component without the need for chemical processing or mechanical removal processes.

Preferably the diffusion bonding resistant layer is a ceramic, an intermetallic or a glass. The specific diffusion bonding resistant layer material dependent on the powder material or solid material, or combination of powder material and solid material being processed. The selection of diffusion bonding resistant layer material is also dependent on the HIP temperatures and pressures used and the geometry of the component being formed.

Preferably the blocking member is formed from a dissolvable material.

Preferably the blocking member is formed from ceramic.

The blocking member is a consumable item, and once the component has been processed, the blocking member has to be removed, providing access to the first canister surface and component surface interface. A ceramic blocking member can be readily dissolved using a suitable alkaline based solution.

Optionally the aperture has a cross section selected from the group comprising: a vee, a semi-circle, a stepped or parallel cross-section. Preferably the corresponding preformed blocking member has a corresponding cross-section to be mateably received in the aperture.

Preferably the aperture is symmetrical about an axis extending from the first surface.

Optionally the blocking member is secured into the aperture of the canister wall by a screw threaded region formed around the external surface of the blocking member, which is mateably received with a corresponding internal screw threaded region on the internal surface of the aperture.

The attachment of a blocking member into the attachment portion is made mechanically. Optionally the blocking member is secured into the aperture of the canister wall by an interlocking mechanism.

The attachment of a blocking member into the attachment portion is made by bonding. Optionally the blocking member is secured into the aperture of the canister wall by an adhesive bonding agent.

The attachment of a blocking member into the attachment portion is made by a frictional fitment. Optionally the blocking member is secured into the aperture of the canister wall through interference fit between the blocking member and the aperture in the canister wall.

Optionally the attachment member has a screw threaded region formed on an external attachment member surface for engaging a complementary screw threaded region on an inner bore of a fluid supply conduit.

Preferably the attachment member is welded to the second surface of the canister wall.

Preferably the canister walls are fabricated from mild steel or a stainless steel.

According to a third aspect of the present invention, there is provided a method of the method comprising the steps of forming an aperture in a canister wall and filling the aperture with a blocking material.

Optionally the blocking material is applied to the aperture as a fluid or paste to fill the aperture and solidified in situ.

Optionally the blocking material is applied to the aperture as a preformed article.

Optionally the blocking member is secured into the canister wall by one or more of the following techniques: fastening the blocking member into the corresponding screw threaded region in the aperture of the canister wall; providing an interlocking mechanism between the blocking member and first or second surface of the canister; adhesively bonding the blocking member into the canister wall aperture; introducing an interference fit between blocking member and canister wall aperture.

Optionally the method further comprising the step of applying a diffusion bonding resistant layer on the first surface. The diffusion bonding resistant layer prevents the component bonding to the canister first surface during processing.

Preferably the diffusion bonding resistant layer is applied by electroplating, physical vapour deposition, chemical vapour deposition, thermal spraying or painting.

Optionally the attachment member can be provided by machining from a solid, fabricating using sheet material or through a casting operation.

BRIEF DESCRIPTION OF THE DRAWINGS

The present invention will be more fully described by way of example with reference to the accompanying drawings in which.

DETAILED DESCRIPTION OF THE INVENTION

Figure 1A:
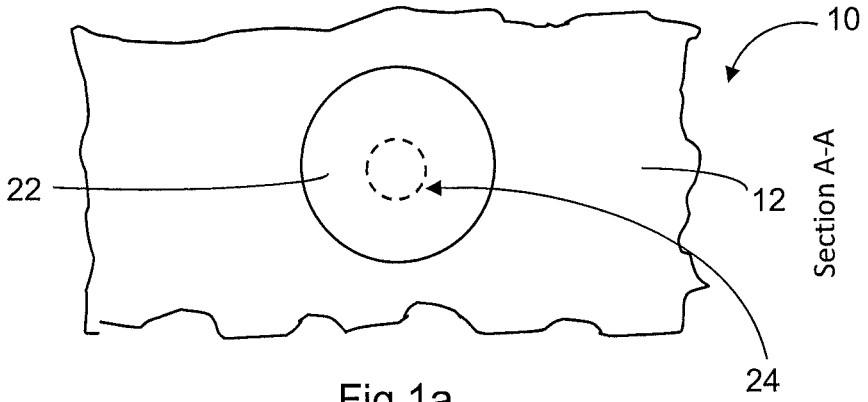
FIG. 1*a* shows a plan view of the metal canister and attached boss.
Figure 1B:
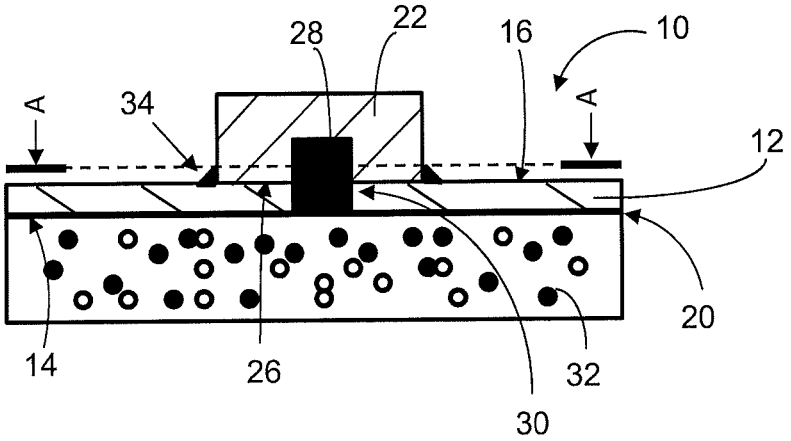
FIG. 1*b* shows a cross-sectional view of the canister configuration prior to HIP processing.

FIGS. 1*a* and 1*b* show in plan view and cross-sectional view respectively a HIP canister configuration prior to processing. The canister configuration 10 comprising a canister 12, the canister having a first surface 14 and a second surface 16, the canister first surface 14 defining the shape of the desired component 18. The canister is fabricated from mild steel or stainless steel sheet material. The wall thickness of the canister will depend on the type of near net shape component that is processed. A thinner canister wall thickness can be used when processing components of a solid nature. A thicker canister wall thickness may be required when processing hollow components, the thicker wall thickness ensuring the canister does not collapse or slump during processing.

The first canister surface 14 can have a diffusion bonding resistant layer 20 deposited thereon. This diffusion bonding resistant layer acts as a layer between the first canister surface 14 and the processed component 18, and either forms a brittle interface or a complete barrier to diffusion. The diffusion bonding resistant layer 20 is typically selected from a ceramic, an inter-metallic or a glass material. The specific choice of diffusion bonding resistant material is dependent on a number of factors, including the canister material, the thickness of the canister walls (i.e., from first surface 14 to second surface 16), the structural and chemical properties of the HIP starting material to be processed, and the pressure and temperature ranges used during the HIP process. The diffusion bonding resistant layer 20 can be deposited by a number of deposition techniques and not limited to electroplating, physical vapour deposition, chemical vapour deposition, thermal spraying or painting.

An attachment member is provided on the second canister surface. The attachment member has a thickness that is substantially greater than the canister wall thickness 14 to 16. The attachment member 22 is typically machined from solid, fabricated using sheet material, or formed from a casting route. A blind aperture 24 is machined substantially into the centre of one face of the attachment member 22. The blind bore 24 can be machined to reach half the depth of the attachment member 22. If cast, the casting method would result in the attachment member 22 and the blind aperture 24 formed in a single casting method. The attachment member 22 may have a screw threaded region 45 formed on an external surface of the attachment member 22 and or may have an internal screw thread region 46 formed on an internal surface of the attachment member 22. This screw threaded region 45 formed on the external surface of the attachment member 22 is used to attach a fluid supply conduit 47 post the completion of the HIP processing and when the component is to be separated from the canister 12, and particularly from the canister first surface. The screw threaded regions may be provided by machining or alternatively the screw threaded regions may be formed during the casting process.

A blocking member 28 is provided and is mainly chosen from a ceramic material, where the ceramic material exhibits material properties enabling the blocking material 28 to be removed post HIP processing by a chemical leaching process. The blocking member 28 can be in the form of fluid, a paste or in the form of a preformed article. A preformed blocking member would generally be processed using a sintering route, thereby providing a structurally robust and rigid blocking member 28. The ceramic blocking member 28 can be integrally included as a core, if the attachment member 22 is manufactured using a casting process.

An aperture 30 is introduced extending from the first canister surface 14 and the canister second surface 16. The aperture 30 can have a cross section selected from a vee; a semi-circle; a stepped; or a parallel cross section. The next stage is to fasten the blocking member 28 in the aperture 30. A fluid or paste based blocking material 28 can be applied to the aperture 30, where upon application, the blocking member 28 solidifies in situ. When considering the preformed blocking member 28, the blocking member 28 can be secured into the aperture 30 within the canister wall 14, 16, by a number of methods. In a first example, the blocking member 28 can have a screw threaded region 48 formed on the external blocking member 28 surface, and is mateably received with a corresponding internal screw threaded region 49 formed on the internal opening surface. In a second example, the blocking member 28 can be secured into the canister wall aperture 30 by an interlocking mechanism. In a third example, the blocking member 28 is secured into the canister wall aperture 30 by using an adhesive bonding agent. In a fourth example, the blocking member 28 is secured into the aperture 30 of the canister wall through an interference fit between the blocking member 28 and the aperture in the canister wall 30.

The attachment member 22, with the secured ceramic blocking member 28 protruding from the blind aperture 24 is aligned to the aperture within the canister wall 30 with the blind aperture face 26 sitting in close relationship with the second canister surface 16. The ceramic blocking member 28 is therefore mateably received into the through opening 30. The ceramic blocking member 28 protrudes and in the main sits flush with the diffusion bonding resistant layer 20 as shown in FIG. 1*b*.

The use of the ceramic blocking member 28 brings a number of advantages over conventional machining to remove the canister. Firstly the ceramic blocking member 28 provides a means to access the interface between component 18 and the canister first surface 14 post processing. Secondly, before the ceramic blocking member 28 is leached out, material is removed from the attachment member 22, e.g. by drilling, to access the ceramic blocking member 28, and this drilling action does not damage the processed component. Thirdly, the use of the ceramic blocking member 28 negates difficult drilling or machining to the already accurately processed near net shape.

Once the attachment member 22 is aligned as mentioned above, the attachment member 22 can be secured to the external canister surface 16. A weld 34, as shown in FIG. 1*b* is formed around the outer surface of the attachment member 22 with the canister second surface 16. The welding process used will generally be tungsten inert gas welding, providing high integrity welds. The attachment member 22 may also be secured to the external canister surface 16 by friction welding.

In operational use, the canister configuration can have numerous attachment members 22 secured to the canister second surface 16. The location of each attachment member 22, will be dependent on the geometry of the final component 18, and positioned to provide the most efficient way to separate the canister first surface 14 from the component 18.

Figure 1C:
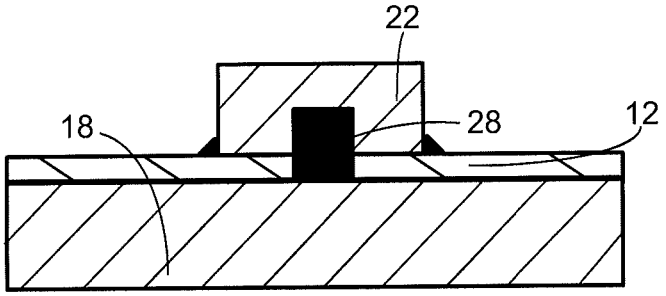
FIG. 1*c* shows a cross-sectional view of the canister configuration post HIP processing.

The canister is now configured, and the HIP process can be initiated. A method of HIP to produce a component is known to the person skilled in the art. Briefly the steps include, introducing raw material into the canister cavity, e.g. powder or solid material or a combination of powder material and solid material 32; evacuating and sealing the canister, applying a combination of high pressure and high temperature to the canister. A near net shaped component 18 is produced, and bounded by the canister first surface 14, see FIG. 1*c*.

Figure 1D:
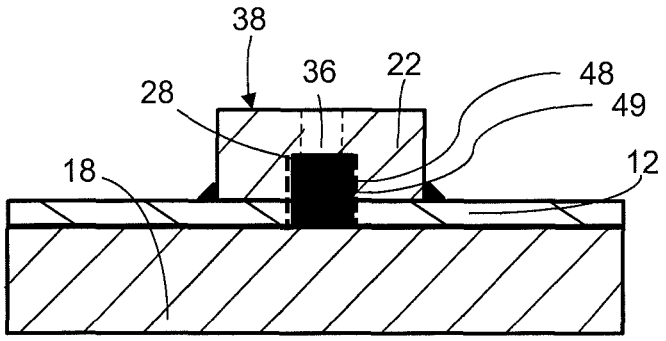
FIG. 1*d* shows a cross-sectional view of the canister and access to the blocking member, inclusive of an optional blocking member location feature.

The next stage is to remove the canister 12 from the component 18. An opening needs to made from the thickened region of the attachment member 22 and uncover the blocking member 28. In one example, an opening 36 is made in the boss 22 by a drilling operation, extending from the top surface of the boss 38 to expose a portion of the blind bore 24 and uncovering the blocking member 28 see FIG. 1*d*. In a second example, a portion of the thickened region of the attachment member 22 can be removed by a grinding operation, and thereby uncovering the blocking member 28. Once access to the blocking member 28 is gained, the blocking member 28 can be chemically leached out.

Figure 1E:
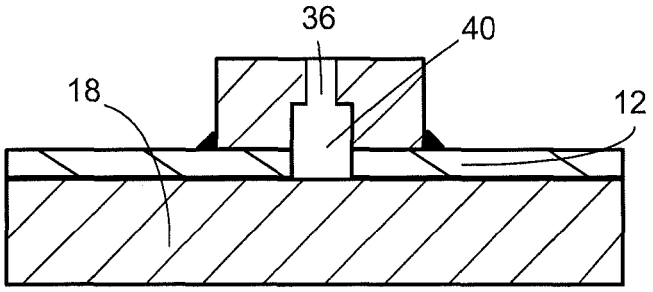
FIG. 1*e* shows a cross-sectional view of the canister blocking member removed.

The blocking member 28 can be removed by applying a solution that dissolves the ceramic blocking member material 28. The solution for leaching out a ceramic based material is normally chosen from an alkali based solution. The specific selection of alkaline based solution is dependent on the material properties of the blocking member 28. It is important that the chosen alkaline based solution does not react with the component surface 18. By way of example, a blocking member plug 28 manufactured from silica rich ceramic may be removed by introducing the ceramic plug 28 with a solution of sodium hydroxide and water. This creates an opening 36 interconnected to an area 40, the area left by the leached blocking member 28, see FIG. 1*e*

The final stage is to provide a mechanism for attaching a fluid supply conduit 47 to the attachment member 22, and applying fluid under pressure through the opening to separate the canister surface from the component. There are a number of ways to connect the fluid supply conduit 47 to the attachment member 22. As mentioned above, the attachment member 22 can have an external screw threaded region 45 or an internal screw threaded region 46. In a first example the step of attaching the fluid supply conduit is conducted by screwing the conduit 47 onto a screw threaded region formed on an external surface 45 of the attachment member 22. In a second example, the step of attaching the fluid supply conduit is conducted by screwing the conduit onto a screw thread formed on an internal surface 46 of the attachment member 22. In a third example, the step of attaching the fluid conduit is conducted by welding the conduit to a portion of the attachment member 22. In a fourth example, the step of attaching the fluid conduit to a portion of the attachment member is by introducing clipping.

Figure 1F:
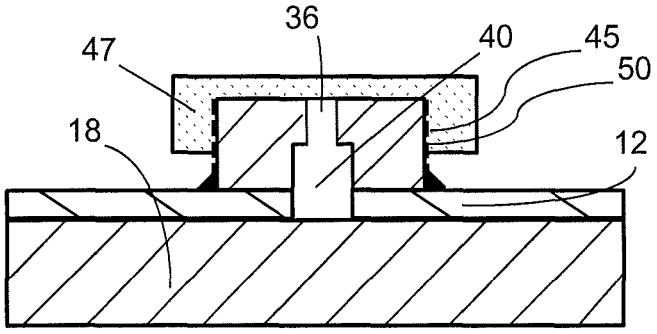
FIG. 1*f* shows a cross-sectional view of the canister inclusive of an attachment feature and a fluid supply conduit.
Figure 1G:
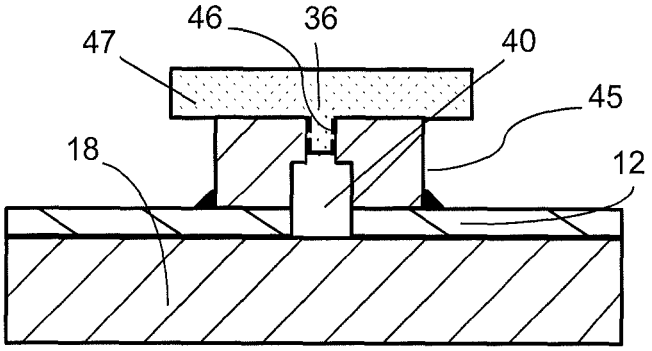
FIG. 1*g* shows a cross-sectional view of the canister inclusive of an alternative attachment feature and a fluid supply conduit arrangement.
Figure 1H:
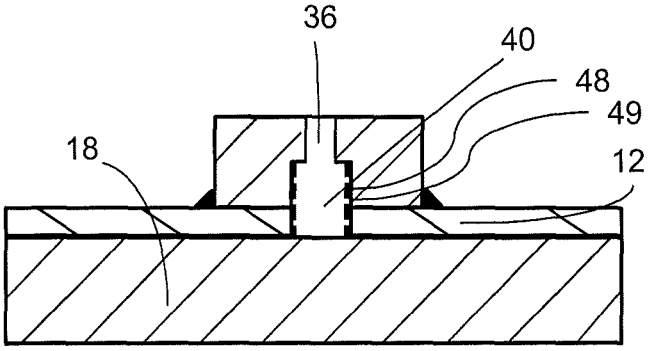
FIG. 1*h* shows a cross-sectional view of the canister blocking member removed, and inclusive of an optional blocking member location feature.
Figure 1J:
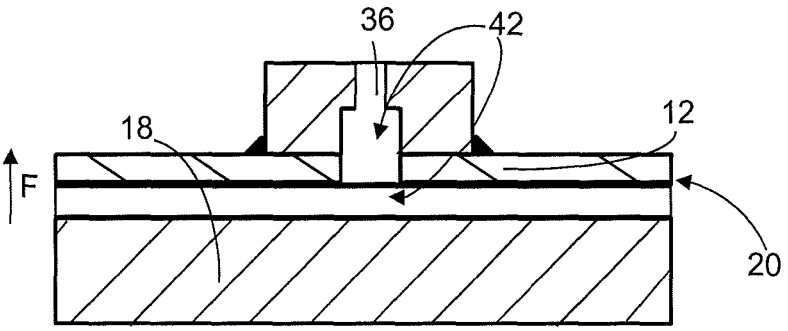
FIG. 1*j* shows a cross-sectional view of separation of component from canister.

FIG. 1*f* shows a fluid 42 injected into the aperture 36 resulting in hydrostatic pressure build up between component 18 and the diffusion bonding resistant layer 20. The fluid used is usually a liquid. The build-up of fluid and hydrostatic pressure acting to force apart and cause separation of canister 12, and canister second surface 16 from the component 18, as shown by arrow F.

The first embodiment was described using a solid attachment member. In a further embodiment of the present invention, the attachment member and plug have different configurations, providing a canister configuration 110. This embodiment is described with the support of FIGS. 2 and 3*a*-3*d* showing a cross-sectional view of a tubular attachment member and blocking member configurations respectively. The focus of this embodiment will therefore be on the tubular attachment member, the blocking member configurations, the interaction of the blocking member and the tubular attachment member prior to HIP processing, and initial stage post HIP processing, i.e. uncovering and gaining the blocking member. For the purposes of this embodiment, the features that are common to both embodiments have their reference numerals increased by 100. Additional features only mentioned in this embodiment are added, starting with 111 and numerically indexed up with odd numerals.

The attachment member 122 has a tubular shape as opposed to a solid attachment member described in the first embodiment. The tubular attachment member is formed from a fabrication manufacturing route and formed from a mild steel or stainless steel. The tubular attachment member 122 has a wall 115 bounding a hollow central region 124.

The longitudinal ends of the tubular attachment member 122, having a first open end 117 and a second open end 119. The first open end 117 used to insert the blocking member 128 within the hollow central region 124. The second open end 119 region has a tubular cross-section configured to locate and position the blocking member 128. This second open end 119 region has a cross-section where the walled thickness 115 increases towards the second open end 119. This increasing wall thickness can be provided by a vee; a semi-circle; or a stepped, wall configuration. The wall thickness configuration is not limited to a particular shape configuration, and needs to have an upper portion capable of receiving a larger part of the blocking member 128, and conversely a lower portion capable of containing the larger portion of the blocking member 128. The configuration of the cross section in the region of the second open end 119 preventing the blocking member from falling into the canister cavity (not shown in the figures).

The end walls 126 of the second open end 119 of the tubular attachment member 122 are positioned and secured to the canister second surface 116 by welding.

The blocking member 128 has an external dimension such that the blocking member 128 can be inserted into the hollow region 124 of the tubular attachment member 122.

FIGS. 3*a*-3*d* show a number of blocking member 128 configurations that can mate up to an opposing configuration formed in the wall thickness configuration in the second open end 119 region.

Figure 3A:
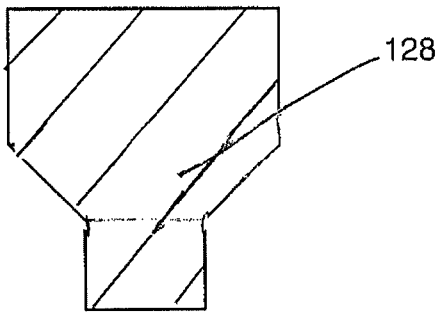
FIGS. 3*a*-3*d* show blocking member cross sections.
Figure 3B:
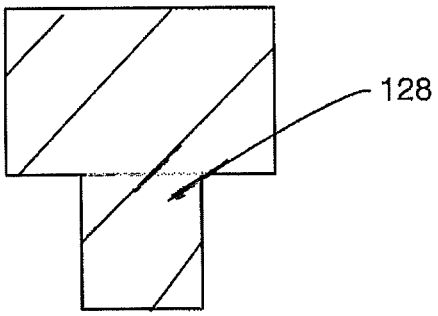
Figure 3C:
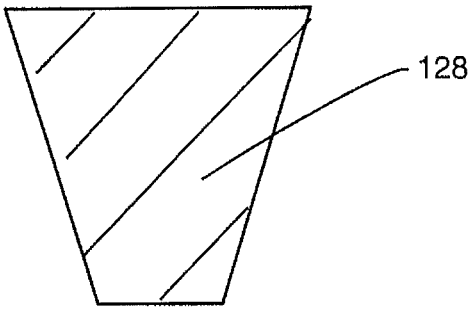
Figure 3D:
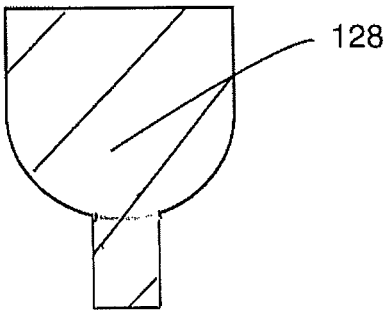

FIG. 3*a* shows a cross sectional view of a blocking member 128, where the blocking member having a uniform diameter to a depth where the cross section gradually tapers to a second diameter (the second diameter smaller than the first diameter), and the second diameter extending with a uniform cross section to a depth. The blocking member 128 can be configured to have a stepped cross section as shown in FIG. 3*b*. The stepped cross section having at least a larger uniform cross section at an upper region of the blocking member reducing to a smaller uniform cross section at lower region. The blocking member shown in FIG. 3*b* can have multiple steps. The blocking member 128 can be configured to have a vee shaped cross section as shown in FIG. 3*c*. The vee configuration having a large first diameter at an upper portion of the blocking member plug 128, and the first diameter gradually reducing to a smaller second diameter. FIG. 3*d* shows a blocking member 128 having a semi-circle configuration. The semi-circle configured blocking member 128 has a first cross section at an upper region of the blocking member 128. The first cross-section gradually decreasing to form a hemispherical shape to a depth and width, where the width is wider than the longitudinal centre line of the blocking member 128, and a uniform cross section extending to the bottom.

An aperture 130 is made extending from the first canister surface 114 and the second canister surface 116. A blocking member 128 is inserted into the first open end 117 of the tubular attachment member 122. The external dimension of the blocking member 128 in engagement with the internal surface 111 of the tubular attachment member 122.

Figure 2:
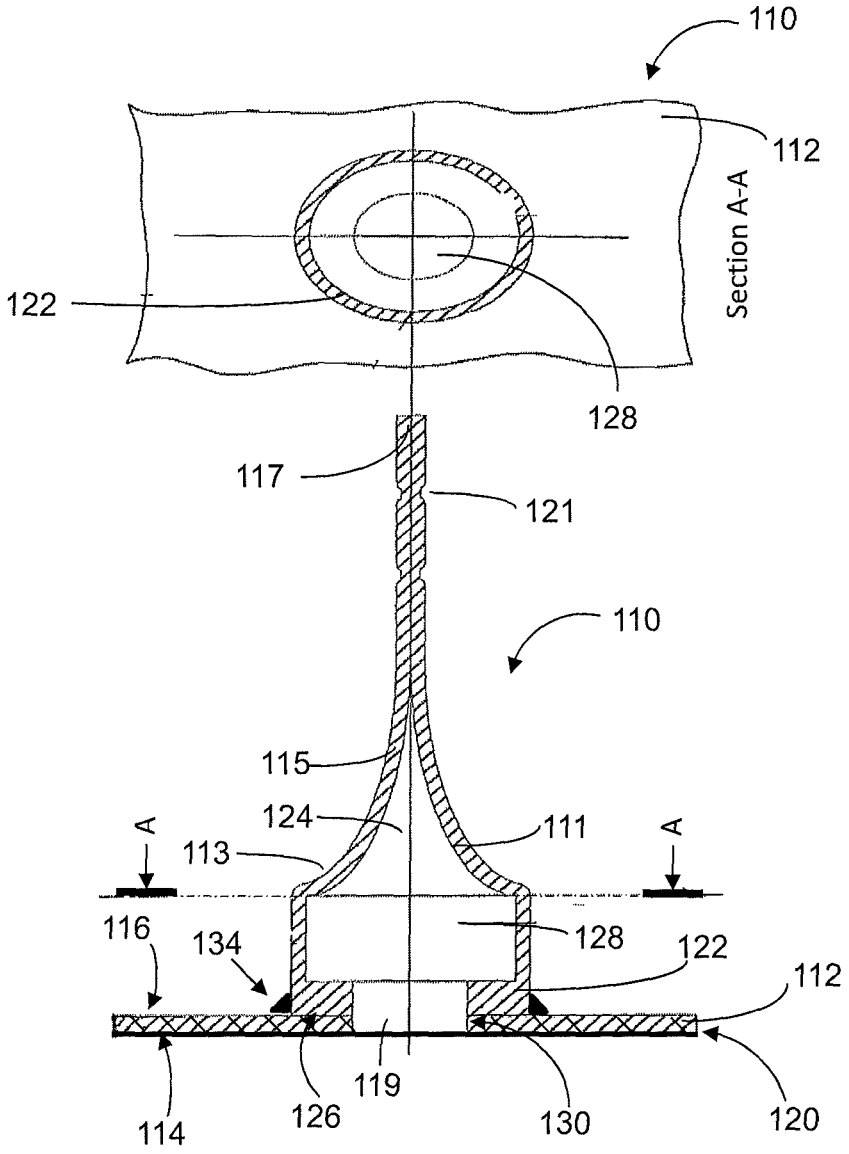
FIG. 2 is a cross sectional view of an alternative canister configuration prior to HIP processing.

The tubular attachment member 122 with the inserted blocking member 128 protruding from the second open end 119 is aligned to the aperture 130, with the planar machined wall surface 126 sitting in close relationship with the external canister surface 116. The blocking member 128 is therefore mateably received into the aperture 130. The blocking member sits flush with the diffusion barrier resistant layer 120 deposited on the first canister surface 114 of the canister as shown in FIG. 2. The blocking member 128 may further protrude into the canister cavity and the powder material (not shown).

Once the tubular attachment member 122 has been aligned as mentioned above, the tubular attachment member 122 can be secured to the second canister surface 116. A weld 134 is formed around the external surface of the tubular attachment member 122 with the canister second surface 116. The welding process of tungsten inert gas is generally used to produce high integrity welds. The ends of the tubular attachment member 122, towards the first open end 117 are crimped shut 121. At least one location is crimped shut using a mechanical crimping method. This method uses pressure welding, where the first open end 117 is heated and then crimped to form a closure by a pressure welding.

The configured canister can then be HIP processed. Again, the main steps include, introducing raw material into the canister cavity, e.g. powder or solid material or a combination of powder material and solid material, evacuating and sealing the canister, applying a combination of high pressure and high temperature to the canister. A near net shaped component is produced, and bounded by the canister internal surface (not shown in FIG. 2).

Post HIP, the next stage is to remove the canister 112 from the component (not shown), and a method of gaining access to the ceramic plug is by mechanically removing at least a portion of the tubular attachment member 122. A manual hand grinding operation can be used to remove a portion of the tubular attachment member material. Once the portion of tubular attachment member material is removed and the access to the blocking member 128 is gained, an alkali based solution can be applied to the blocking member 128, thereby dissolving the blocking member material 128.

The final stage is to provide a mechanism for attaching a fluid supply conduit (not shown) to a portion of the tubular attachment member 122 or to the second canister surface 116. This attachment is provided by welding the conduit to either a portion of the tubular attachment member 122 or to the second canister surface 116.

Fluid is injected into the attached fluid supply conduit resulting in hydrostatic pressure build up between component and the diffusion bonding resistant layer 120. The build-up of fluid and hydrostatic pressure acting to force apart and cause separation of canister 112 from the component. Note that some of the features are not shown in this embodiment, and the removal of the canister 112 from the component during the injecting of pressure fluid causing hydrostatic pressure, is in the main the same as described in the first embodiment.

In an example of the present invention, the internal canister surface 14, 114 may not require a diffusion bonding resistant layer 20, 120 deposited on it. In this method a material, e.g. a ceramic is processed in the same way as the aforementioned HIP process, and using a metal canister 12, 112. Here, on HIP processing, the formed ceramic component 18 will not tend to adhere or bond to the internal canister surface 14, 114 due to the mismatch in chemical and structural properties of both metal canister 12, 112 and the ceramic component 18.

The features of the embodiments may be interchangeable. The shape of the blocking member, the method of gaining access to the blocking member, the methods of removing material from the attachment member to uncover blocking member are all interchangeable and not limited to one specific embodiment. Both attachment member and blocking member are not restricted to one particular shape, and the shapes used within the embodiments are to give one example. Where a singular attachment member is stated, it can also mean a plurality of attachment members. In practice the canister assembly may take the form of a combination of using tubular attachment members and solid attachment members.

The invention claimed is:

1. A method of separating a hipping (Hot Isostatic Pressing) canister from a HIPped component, the method comprising steps of:

providing the hipping canister with a metallic canister wall having a first surface and an opposite second surface, wherein an aperture opens to the first surface and contains a blocking member, the second surface having an attachment feature arranged to attach a fluid supply conduit to the attachment feature;

removing the blocking member to create an opening extending through a wall of the hipping canister; and separating the first surface from the HIPped component by supplying a fluid under pressure through the opening.

2. The method according to claim 1, wherein the canister wall has a thickened region in the region of the opening, the method comprising removing a portion of the thickened region to uncover the blocking member, the blocking member comprised of a blocking material.

3. The method according to claim 2, wherein the portion of the thickened region is removed by drilling or grinding.

4. The method according to claim 2, wherein the blocking member is removed by applying a solution to the blocking material that dissolves the blocking material.

5. The method according to claim 2, wherein the thickened region has the attachment feature for the fluid supply conduit, wherein the method comprises the step of attaching the fluid supply conduit to the attachment feature.

6. The method according to claim 5, wherein the step of attaching the fluid supply conduit comprises one or more of the following:

screwing the conduit onto a screw thread formed on an external surface of the attachment feature, screwing the conduit onto a screw thread formed on an internal surface of the attachment feature, and clipping or welding the conduit to the attachment feature.

7. A canister for a hot isostatic press (HIP) process comprising a metallic canister wall having a first surface and an opposite second surface, wherein:

an aperture opens to the first surface and contains a blocking member, and the second surface has an attachment member arranged to attach a fluid supply conduit to the attachment member such that fluid can be supplied through the aperture when the blocking member is removed from the aperture.

8. The canister according to claim 7, wherein the attachment member comprises a thickened region extending from the second surface.

9. The canister according to claim 8, wherein the aperture extends from the first surface into the attachment member and the blocking member extends into the attachment member.

10. The canister according to claim 7, wherein a diffusion bonding resistant layer is deposited on the first canister surface.

11. The canister according to claim 7, wherein the blocking member is formed from a dissolvable material.

12. The canister according to claim 7, wherein the blocking member is secured into the aperture of the canister wall by a mechanism that includes one or more of the following: a screw threaded region formed around the external surface of the blocking member, which is mateably received with a corresponding internal screw threaded region formed on the internal surface of the aperture, an interlocking mechanism, an adhesive bonding agent, or by interference fit between the blocking member and the aperture in the canister wall.

13. The canister according to claim 7, wherein the attachment member has a screw threaded region formed on an external attachment member surface for engaging a complementary screw threaded region on an inner bore of a fluid supply conduit.

14. The canister according to claim 7, wherein the attachment member is welded to the second surface of the canister wall.

* * * * *